US006643967B1

(12) United States Patent
Bloom

(10) Patent No.: US 6,643,967 B1
(45) Date of Patent: Nov. 11, 2003

(54) DISPLAY DEVICE

(76) Inventor: Donald Bloom, 1133 Donaldo Ct., South Pasadena, CA (US) 91030

( * ) Notice: Subject to any disclaimer, the term of this patent is extended or adjusted under 35 U.S.C. 154(b) by 0 days.

(21) Appl. No.: 10/139,054

(22) Filed: May 3, 2002

(51) Int. Cl.[7] ..... A47G 1/06

(52) U.S. Cl. ..... 40/789; 40/746; 40/750; 40/754; 40/755

(58) Field of Search ..... 40/786, 788, 789, 40/746, 750, 754, 755, 774

(56) References Cited

U.S. PATENT DOCUMENTS 2,991,578 A * 7/1961 Messina ..... 40/750
4,244,128 A * 1/1981 Russell ..... 40/789
4,244,511 A * 1/1981 Coleman ..... 40/774
4,993,177 A * 2/1991 Hudson ..... 40/725
5,787,627 A * 8/1998 Snoke et al. ..... 40/791
6,161,321 A * 12/2000 Huber ..... 40/789
2003/0017129 A1 * 1/2003 Maleeny et al. ..... 40/725

* cited by examiner

*Primary Examiner*—Gary Hoge
(74) *Attorney, Agent, or Firm*—James E. Brunton

(57) ABSTRACT

A display device for displaying a generally planar artwork display member such as a photograph or the like. The display device includes a foldable enclosure member which, when folded forms a structurally sound, frame-like assembly that substantially encloses and supports the artwork display member and also supports a generally planar scent emitting member such as a fragrant impregnated blotter.

13 Claims, 3 Drawing Sheets

FIG. 1
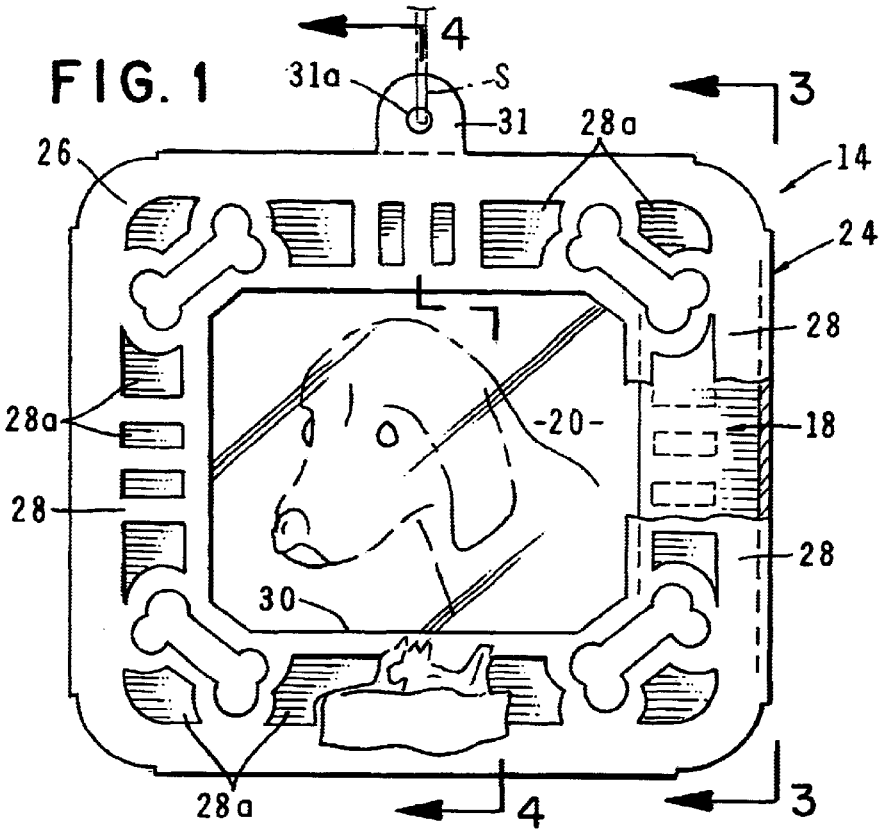
FIG. 2
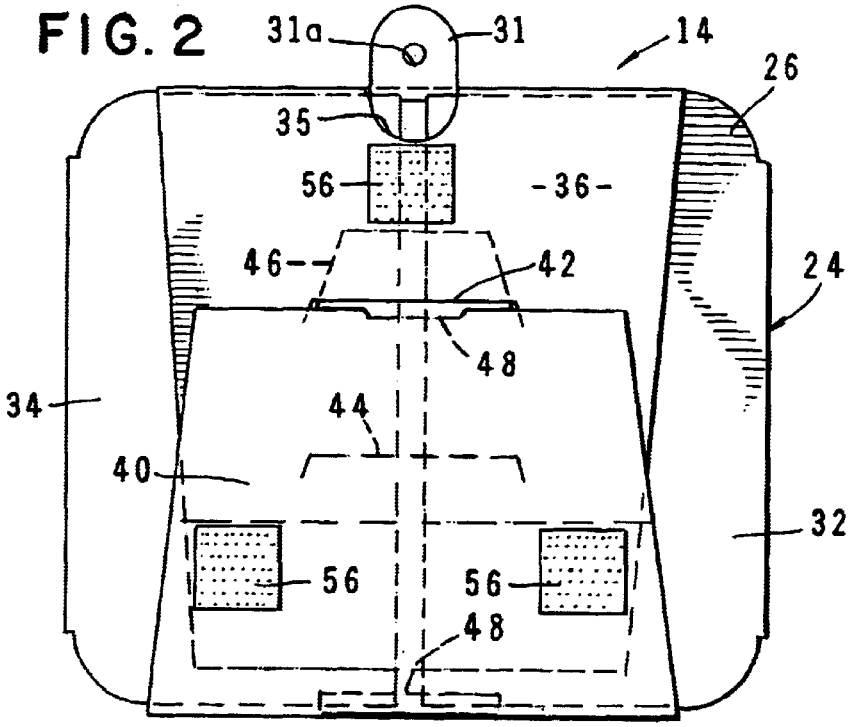
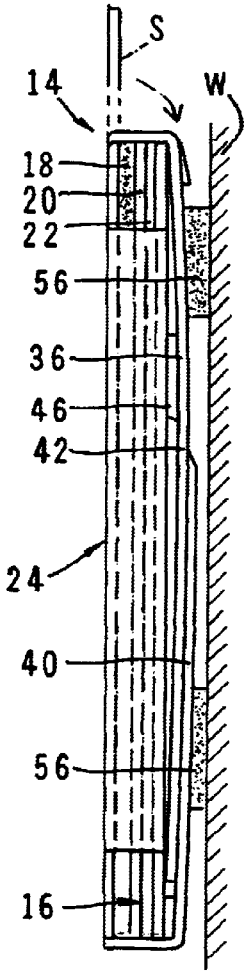
FIG. 3

14
16
18
20
22
24
28
28a
30
31
31a
32
34
35
36
40
42
44
46
48
56
56a
H
6

DISPLAY DEVICE

BACKGROUND OF THE INVENTION

1. Field of the Invention

The present invention relates generally to novelty display devices for displaying artwork. More particularly the invention concerns a self-supporting picture frame formed from a foldable planar member that, when strategically folded, functions not only to attractively display the artwork but also functions to carry an air freshener card for controllably emitting a scent through openings provided in the marginal portion of the front panel of the picture frame.

2. Discussion of the Prior Art

The prior art is replete with various types of hanging devices for hanging in living spaces and in the passenger compartment of cars and trucks that include air freshener components for emitting a scent. Frequently these devices comprise a scented card that is adapted to be hung in the living space or from the rear-view mirror or the sun shades in a vehicle.

Similarly the prior art is replete with various types of frames for displaying artwork such as photographs and the like. U.S. Pat. No. 5,361,522 to issued to green discloses a combination air freshener and picture frame that includes a front frame to receive a picture and a removable back insert that can be attached to the frame to retain the picture against the front face of the picture frame. The front frame has a central opening for viewing the picture in the frame and an enclosure adjacent to the rear portion of the frame contains an air freshener material. The enclosure has openings to allow diffusion of the air freshener scent into the ambient atmosphere.

This invention provides a simple and inexpensive frame for containing the air freshener and for attractively displaying the artwork. In one form of the invention the air freshener comprises a planar material stock that has been impregnated with selected fragrance. Uniquely the picture frame of the invention is formed from a foldable planar member which, when strategically folded, securely holds the air freshener and the artwork securely in position within the frame. More particularly, the foldable planar member is provided with a plurality of strategically located slits and cooperating locking tabs that are lockably receivable within the slits so that when the planar member is in its folded condition it provides a front panel having an opening for displaying the artwork and cooperating foldable panels for securing the artwork and the air freshener in position within the frame. The foldable planar member also includes a locking panel which, when in one position provides means for supporting the picture frame in an upstanding configuration. When the locking panel is in an alternate position it resides in close engagement with a pair of foldable side panels that are disposed in holding engagement with the artwork.

SUMMARY OF THE INVENTION

It is an object of the present invention to provide a novel display device for displaying a generally planar artwork display member such as a photograph or the like. The display device uniquely includes a foldable enclosure member which, when folded forms a structurally sound, frame like assembly that substantially encloses and supports the artwork display member and also supports a generally planar scent emitting member such as a fragrance-impregnated blotter.

Another object of the invention is to provide a display device of the aforementioned character that can be affixed to a vertical surface such as a wall, that, using a foldable hang tab can be hung from a rigid part of the interior of the automobile such as an automobile rearview mirror or visor or, alternatively, can be positioned in an upright position on a flat surface such as a dashboard or desktop.

Another object of the invention is to provide a display device that houses the scent emitting member in a manner so as to effectively dispense a desired fragrance into the ambient atmosphere over an extended period of time.

Another object of the invention is to provide a display device as described in the preceding paragraphs which is lightweight, is attractive in appearance, is versatile in use and is of a simple construction so that it can be easily assembled without the use of special tools.

More particularly, it is an object of the invention to provide a display device which allows the scent-emitting member to be unobtrusively hidden behind an aesthetically pleasing frame like assembly that is uniquely formed by the folded enclosure member.

Another object of the invention is to provide a display device as described in the preceding paragraph in which the frame like assembly is provided with strategically located openings to allow diffusion of the air freshener scent into the ambient atmosphere.

Another object of the invention is to provide a display device that includes means for holding the scented member in a fixed position within the frame like assembly so as to prevent moisture from the fragrance or scent from contacting the artwork carried by the device.

Another object of the invention is to provide a display device that is uniquely constructed so as to enable the user to quickly and easily replace the artwork being displayed.

Another object of the invention is to provide a display device as described in the preceding paragraph which can be inexpensively manufactured in quantity. The foregoing objects of the present invention as well as other objectives of the invention will be more readily understood in view of the following detailed description and the drawings illustrating the apparatus of the invention.

BRIEF DESCRIPTION OF THE DRAWINGS

FIG. 1 is a front view of one form of the display device of the invention.

FIG. 2 is a rear view of the display device shown in FIG. 1.

FIG. 3 is a view taken along lines 3—3 of FIG. 1.

DESCRIPTION OF THE INVENTION

Figures 4, 5, 6:
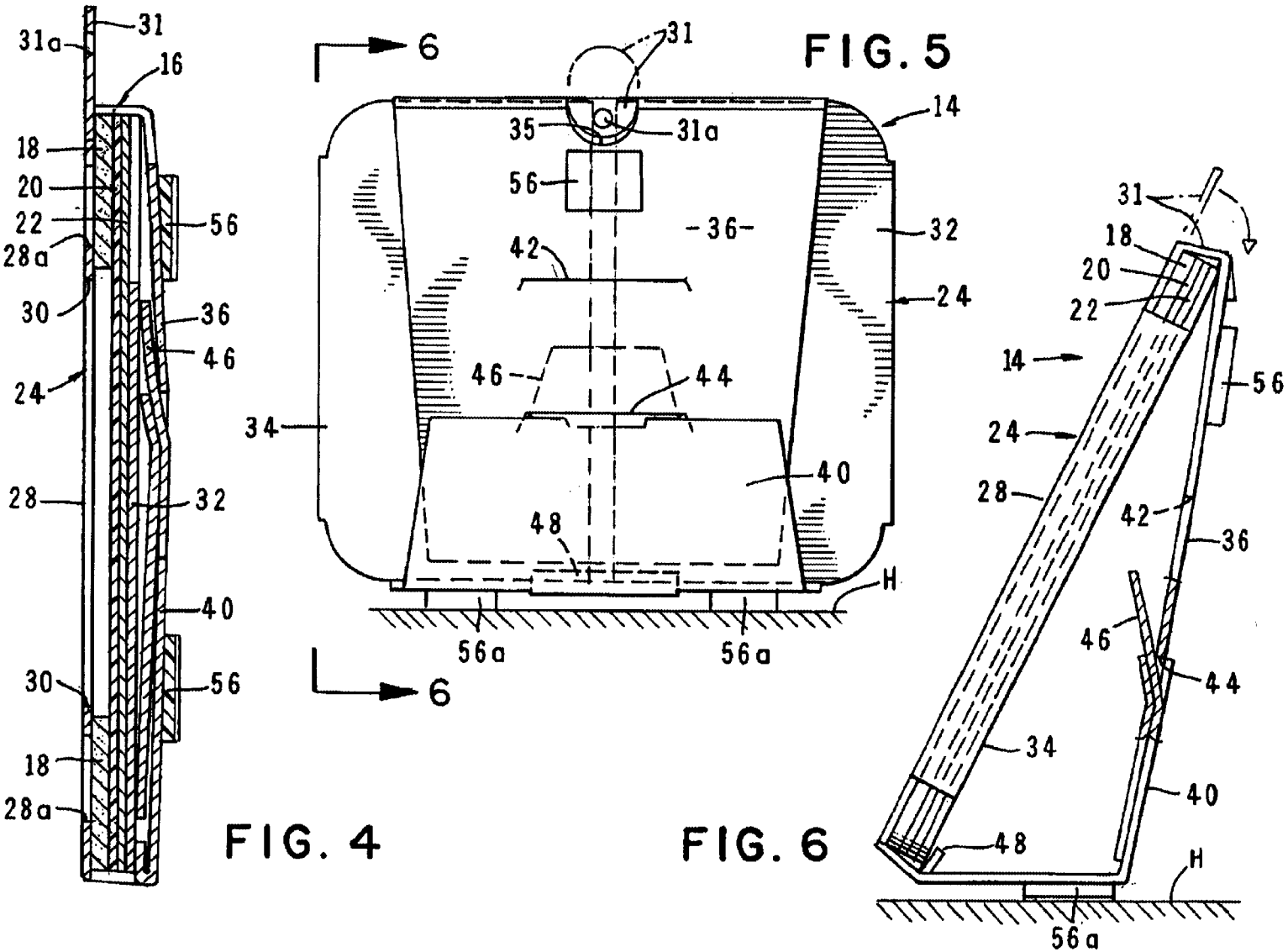
FIG. 4 is an enlarged, cross-sectional view taken along lines 4—4 of figure
FIG. 5 is a rear view of the display device folded in a manner such that the device can be positioned on a flat surface such as a desk top.
FIG. 6 is a view taken along lines 6—6 of FIG. 5.
Figure 7:
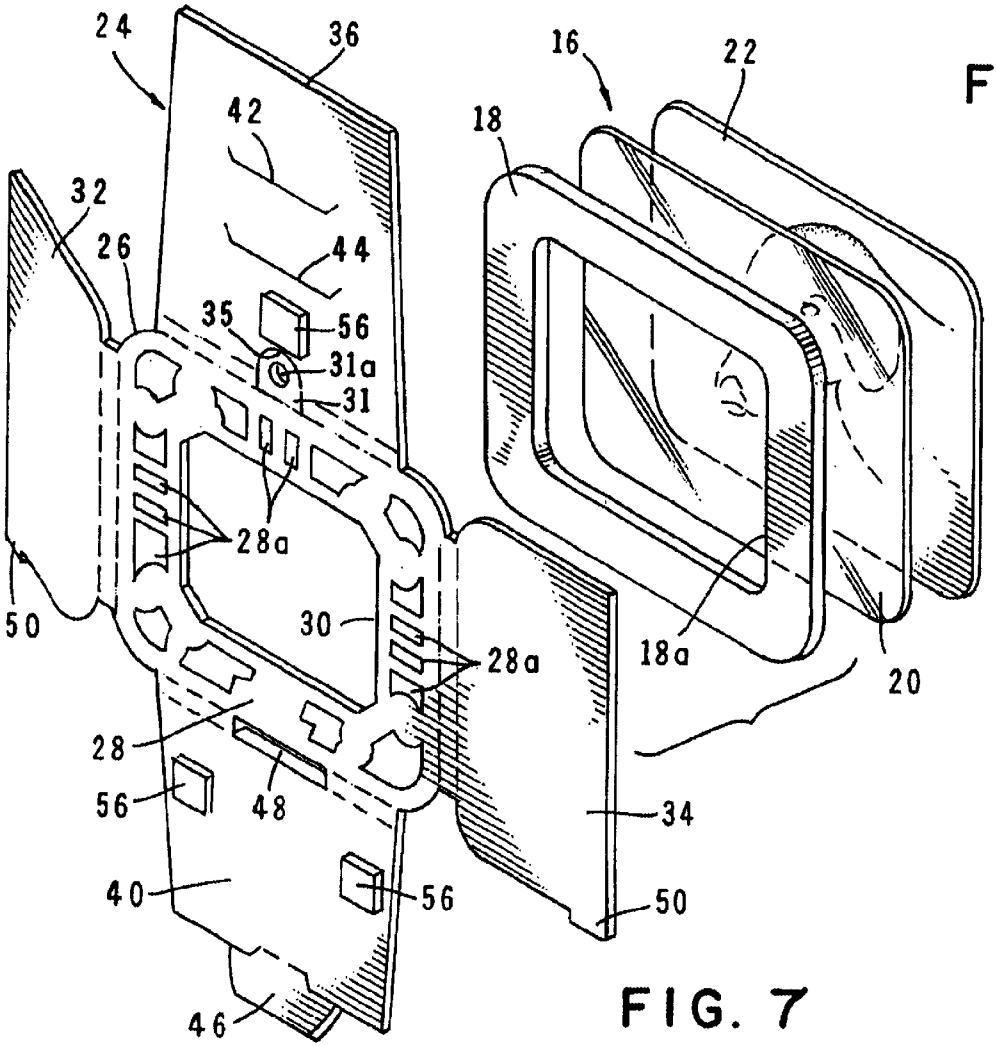
FIG. 7 is a generally perspective, exploded view of the display device shown in FIG. 1.

Referring to the drawings and particularly to FIGS. 1, 2, and 7, one form of the display device of the present invention is there shown and generally designated by the numeral 14. As best seen in FIGS. 4 and 7, the display device here comprises a laminant construction 16 that is made up of a generally planar-shaped, scent-emitting, blotter-like member 18, a generally planar, substantially transparent member 20 and a generally planar artwork display member 22.

Also forming a part of the display device of the invention is a foldable enclosure 24 for substantially enclosing the laminant construction 16 in the manner shown in FIGS. 3 and 6. Foldable enclosure 24 comprises a generally planar, foldable member 26 constructed of paper or plastic that has a central portion 28 that is disposed in engagement with the generally planar, scent-emitting member 18. Central portion 28 is provided with a central opening 30 and with an upwardly extending, foldable apertured hang tab 31 the purpose of which will presently be described.

Also forming a part of planar member 26 is a first side portion 32 that is foldable from a first position shown in FIG. 7 to a second position shown in FIGS. 2, 3 and 4 wherein the first side portion is in engagement with the generally planar artwork display member 22. Similarly is a second side panel 34 of planar member 26 is foldable from a first position shown in FIG. 7 to a second position shown in FIGS. 2, 3, and 4 wherein the panel is in engagement with the generally planar artwork display member 22.

Figure 8:
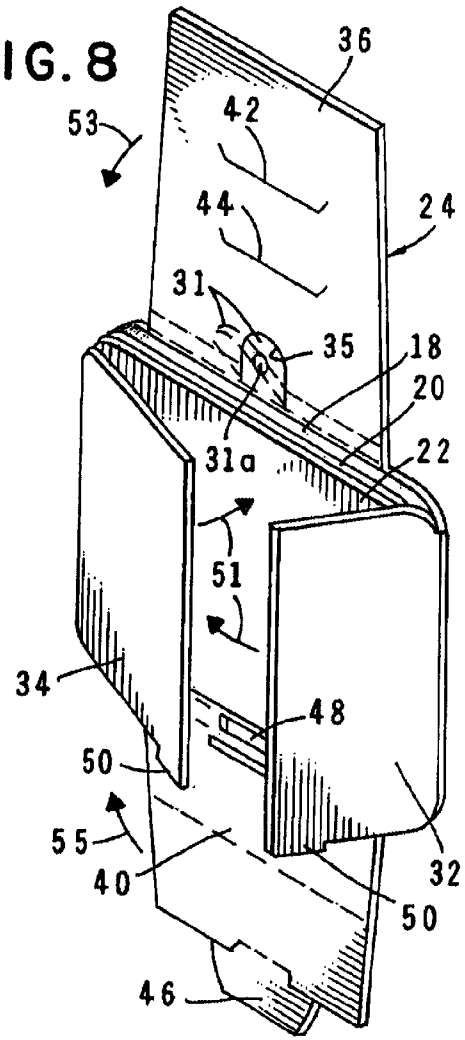
FIG. 8 is a generally perspective, diagrammatic view showing the initial steps in the method of folding the foldable enclosure of the display device shown in FIG. 1.

As best seen in FIG. 7, the generally planar member 26 includes a top portion 36 that is foldable from a first position shown in FIGS. 7 and 8 into a second position shown in FIGS. 2, 3, and 4 wherein said top portion overlays said first and second side portions. Generally planar member 26 also includes a bottom portion 40 that is foldable from a first position shown in FIGS. 7 and 8 into a second position shown in FIGS. 2 and 4 where it overlays top portion 36.

Top portion 36 is provided with first and second spaced-apart slits 42 and 44, the purpose of which will presently be described. As best seen in FIG. 7, bottom portion 40 includes a first locking tab 46 that is receivable in a selected one of the first and second spaced-apart slits 42 and 44. Bottom portion 40 also includes an engagement flap 48 that is engagable by outwardly extending engagement tabs 50 formed proximate the outer edges of first and second side panels 32 and 34 (FIG. 7). Top portion 36 further includes a generally arch-shaped opening 35 that receives hang tab 31 when planar member 26 is in an unfolded configuration.

In using the display device of the present invention, with the generally planar foldable member 26 in the unfolded configuration shown in FIG. 7, the laminant construction 16 is moved into engagement with the rear surface of the member so that an opening 18*a* formed in scent-emitting member 18 is indexably aligned with opening 30 formed in member 26. In this position, the artwork is separated from scent emitting member 18 and is protected by the substantially transparent member 20. With the laminant construction in engagement with the rear surface of the planar member 26, flaps 32 and 34 are folded inwardly in the direction of the arrows 51 in FIG. 8. While holding the side panels 32 and 34 in engagement with the artwork member 22, top panel 36 is folded downwardly in the direction of arrow 53 of FIG. 8 and into engagement with the folded side panels 32 and 34 in the manner shown in FIG. 5. Holding top panel 36 in engagement with the side panels, the bottom panel 40 is next folded upwardly in the direction of the arrow 55 into the position shown in either FIG. 2 where flap 46 is inserted into slit 42 or, alternatively, into the position shown in FIG. 5 where tab 46 is inserted into lower slit 44. When the tab is inserted into the upper slit 42, the device has the folded configuration shown in FIGS. 1, 2, 3 and 4 wherein it can be readily affixed to a wall surface such as wall surface "W". The assemblage can be held in position against wall surface "W" by a gripping means, here provided as a plurality of spaced-apart segments of double-sided adhesive tape 56. Alternatively the assemblage can be hung from a nail or similar structure using a loop of string or wire "S" that is entrained through the aperture 31*a* formed in hang tab 31 (FIG. 1) when the tab is folded from the folded configuration shown in FIG. 5 to the upstanding configuration shown in FIG. 1.

When tab 46 is inserted into lower slit 44 as shown in FIG. 5, the device takes on the configuration shown in FIG. 6 wherein the device can be positioned on a flat, horizontal surface such as surface "H" and can be held in position thereon by means of the gripping means, or segments of double-sided tape designated in FIG. 6 as 56*a*. In either case, the fragrance from impregnated card 18 can freely flow into the ambient atmosphere via the plurality of openings 28*a* formed in the marginal portion of the central portion 28.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following documents.

I claim:

1. A display device comprising:

(a) a laminate construction including:
  (i) a generally planar, scent emitting member; and
  (ii) a generally planar artwork display member;

(b) a foldable enclosure for substantially enclosing said laminate construction, said foldable enclosure comprising a generally planar foldable member having:
  (i) a central portion disposed in engagement with said generally planar, scent emitting member, said central portion having a viewing opening formed therein;
  (ii) a first side portion foldably from a first position into a second position in engagement with said generally planar artwork display member;
  (iii) a second side portion foldably from a first position into a second position in engagement with said generally planar artwork display member;
  (iv) a top portion foldable from a first position into a second position in engagement with said first and second side portions, said top portion having first and second spaced apart slits; and
  (v) a bottom portion foldable from a first position into a second position overlaying said top portion, said bottom portion having a first locking tab receivable in a selected one of said first and second spaced apart slits.

2. The display device as defined in claim 1 in which each of said first and second side panels has an outwardly extending engagement tab and in which said bottom portion further includes an engagement flap movable into engagement with said engagement tabs of said first and second side portions when said bottom portion is folded into said second position.

3. The display device as defined in claim 1 in which said central part of said generally planar foldable member includes a marginal portion circumscribing said viewing opening, said marginal portion having a plurality of scent emitting openings formed therein.

4. The display device as defined in claim 1 in which said central portion of said foldable enclosure includes an upstanding, apertured hang tab and in which said top portion of said foldable enclosure includes an opening for receiving said hang tab.

5. The display device as defined in claim 1 in which each of said top and bottom portions of said generally planar foldable member includes surface-gripping means.

6. A display device comprising:

(a) a laminate construction including:
  (i) a generally planar, scent emitting member;
  (ii) a generally planar, substantially transparent member; and
  (iii) a generally planar artwork display member;

(b) a foldable enclosure for substantially enclosing said laminate construction, said foldable enclosure comprising a generally planar foldable member having:
  (i) a central portion disposed in engagement with said generally planar, scent emitting member, said central portion having a viewing opening formed therein and a marginal portion circumscribing said viewing opening, said marginal portion having a plurality of scent emitting openings formed therein;
  (ii) a first side portion foldable from a first position into a second position in engagement with said generally planar artwork display member;
  (iii) a second side portion foldable from a first position into a second position in engagement with said generally planar artwork display member;
  (iv) a top portion foldable from a first position into a second position in engagement with said first and second side portions, said top portion having first and second spaced apart slits; and
  (v) a bottom portion foldable from a first position into a second position overlaying said top portion, said bottom portion having a first locking tab receivable in a selected one of said first and second spaced apart slits.

7. The display device as defined in claim 6 in which each of said first and second side panels has an outwardly extending engagement tab and in which said bottom portion further includes an engagement flap movable into engagement with said engagement tabs of said first and second side portions when said bottom portion is folded into said second position.

8. The display device as defined in claim 6 in which said central portion of said foldable enclosure includes an upstanding, apertured hang tab and in which said top portion of said foldable enclosure includes an opening for receiving said hang tab.

9. The display device as defined in claim 6 in which each of said top and bottom portions of said generally planar foldable member includes surface-gripping means.

10. A display device comprising:

(a) a laminate construction including:
  (i) a generally planar, scent emitting member;
  (ii) a generally planar, substantially transparent member; and
  (iii) a generally planar artwork display member;

(b) a foldable enclosure for substantially enclosing said laminate construction, said foldable enclosure comprising a generally planar foldable member having:
  (i) a central portion disposed in engagement with said generally planar, scent emitting member, said central portion having a viewing opening formed therein and a marginal portion circumscribing said viewing opening, said marginal portion having a plurality of scent emitting openings formed therein;
  (ii) a first side portion foldable from a first position into a second position in engagement with said generally planar artwork display member, said first side portion having an outwardly extending engagement tab;
  (iii) a second side portion foldable from a first position into a second position in engagement with said generally planar artwork display member, said second side portion having an outwardly extending engagement tab;
  (iv) a top portion foldable from a first position into a second position in engagement with said first and second side portions, said top portion having first and second spaced apart slits; and
  (v) a bottom portion foldable from a first position into a second position overlaying said top portion, said bottom portion having a first locking tab receivable in a selected one of said first and second spaced apart slits, said bottom portion further including an engagement flap movable into engagement with said engagement tabs of said first and second side portions when said bottom portion is folded into said second position.

11. The display device as defined in claim 10 in which said central portion of said foldable enclosure includes an upstanding, apertured hang tab and in which said top portion of said foldable enclosure includes an opening for receiving said hang tab.

12. The display device as defined in claim 10 in which said generally planar foldable member includes at least one surface-gripping means.

13. The display device as defined in claim 10 in which each of said top and bottom portions of said generally planar foldable member includes at least one surface-gripping means provided in the form of double sided adhesive tape.

* * * * *